US006352461B1

(12) United States Patent
Hoffman

(10) Patent No.: US 6,352,461 B1
(45) Date of Patent: Mar. 5, 2002

(54) WATER RESCUE DEVICE AND METHOD

(76) Inventor: Lance D. Hoffman, 3843 U.S. 42, S., Rte. 9, Mansfield, OH (US) 44904

( * ) Notice: Subject to any disclaimer, the term of this patent is extended or adjusted under 35 U.S.C. 154(b) by 0 days.

(21) Appl. No.: 09/663,328

(22) Filed: Sep. 18, 2000

(51) Int. Cl.[7] ..... B63C 9/08
(52) U.S. Cl. ..... 441/81; 441/131
(58) Field of Search ..... 441/80, 81, 82, 441/83, 84, 88, 131

(56) References Cited

U.S. PATENT DOCUMENTS

| | | | | | |
|---|---|---|---|---|---|
| 831,891 | A | * | 9/1906 | Quarterman | 441/81 |
| 4,144,607 | A | | 3/1979 | Soubie | 9/339 |
| 4,464,132 | A | * | 8/1984 | Mauck | 441/81 |
| 4,540,372 | A | * | 9/1985 | Mauck | 441/81 |
| 4,976,642 | A | | 12/1990 | Wilkie | 441/131 |
| 5,895,299 | A | | 4/1999 | Hyde | 441/84 |
| 6,042,440 | A | | 3/2000 | Ettl | 441/88 |
| 6,050,869 | A | | 4/2000 | Kellett | 441/83 |
| 6,056,612 | A | | 5/2000 | Markwitz | 441/122 |

FOREIGN PATENT DOCUMENTS

| | | | | |
|---|---|---|---|---|
| DE | 3813870 | * | 11/1989 | 441/83 |

* cited by examiner

*Primary Examiner*—Stephen Avila
(74) *Attorney, Agent, or Firm*—Emerson & Skeriotis; John M. Skeriotis

(57) ABSTRACT

A water rescue device which can be easily secured to the arm of a victim, thereby, enabling the victim to be pulled from the water without having to grasp onto the device is provided. The water rescue device has a floatation member with an aperture extending therethrough to receive the victim's arm, a belt having an adjustment means to allow the belt to be secured to the victim's arm, an attachment means for securing the belt to the floatation member and a rescue line attached to the adjustment means. A rescuer, while holding onto the rescue line, can throw the flotation member to the victim. The victim can place his or her arm through the aperture in the flotation member. Once the victim has placed his or her arm through the aperture, the rescuer can pull on the rescue line causing the adjustment means to secure the belt to the victim's arm. And, then the rescuer can use the rescue line to pull the victim from the water.

11 Claims, 3 Drawing Sheets

WATER RESCUE DEVICE AND METHOD

BACKGROUND OF THE INVENTION

I. Field of the Invention

The present invention relates to water rescue devices and, more particularly, to a water rescue device that can be easily secured to the arm of a victim to allow a rescuer to pull a victim from the water, thus leading to safety.

II. Description of the Related Art

The present invention contemplates a new and improved water rescue device which is simple in design, effective in use, and overcomes the foregoing difficulties and others while providing better and more advantageous overall results.

It is well known in the art to use a water rescue device to rescue a victim in distress in the water. Typically, these rescue devices are comprised of a floatation member and a rescue line attached thereto. A rescuer can throw the floatation member to the victim who can then grasp the floatation member and be pulled from the water.

A problem known in the art, however, relates to the difficulty that the victim has in grasping the floatation member. The victim may be in a state of shock or panic making it difficult for him or her to grasp onto the floatation member. The victim may also become unconscious making it impossible for him or her to continue grasping onto the floatation member. Accordingly, what is needed is water rescue device that can be tightened around the victim's arm such that the victim does not have to grasp onto the floatation member.

The present invention meets this need by providing a water rescue device that can be secured to the victim's arm and, thereby, enable the victim to be pulled from the water without having to grasp onto the floatation member.

SUMMARY OF THE INVENTION

In accordance with the present invention, a new and improved water rescue device is provided which can be easily secured to the victim's arm, thereby, enabling the victim to be pulled from the water without having to grasp onto the floatation member.

It is an objective of this invention to provide a water rescue device that is easily and efficiently manufactured and marketed.

It is a further objective of this invention to provide a water rescue device that is of durable and reliable construction.

It is still a further objective of this invention to provide a water rescue device that has all of the advantages of the prior water rescue devices and none of the disadvantages.

To accomplish these objectives, the present invention provides for a water rescue device, having a customary floatation member with an aperture extending therethrough to receive the victim's arm, a belt having an adjustment means to allow the belt to be secured to the victim's arm, an attachment means for securing the belt to the floatation member and a rescue line attached to the adjustment means. A rescuer, while holding onto the rescue line, can throw the flotation member to the victim. The victim can place his or her arm through the aperture in the flotation member. Once the victim has placed his or her arm through the aperture, the rescuer can pull on the rescue line causing the adjustment means to secure the belt to the victim's arm. And, then the rescuer can use the rescue line to pull the victim from the water.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts. A preferred embodiment of these parts will be described in detail in the specification and illustrated in the accompanying drawings, which form a part of this disclosure and wherein.

DESCRIPTION OF THE PREFERRED EMBODIMENT

Figure 1:
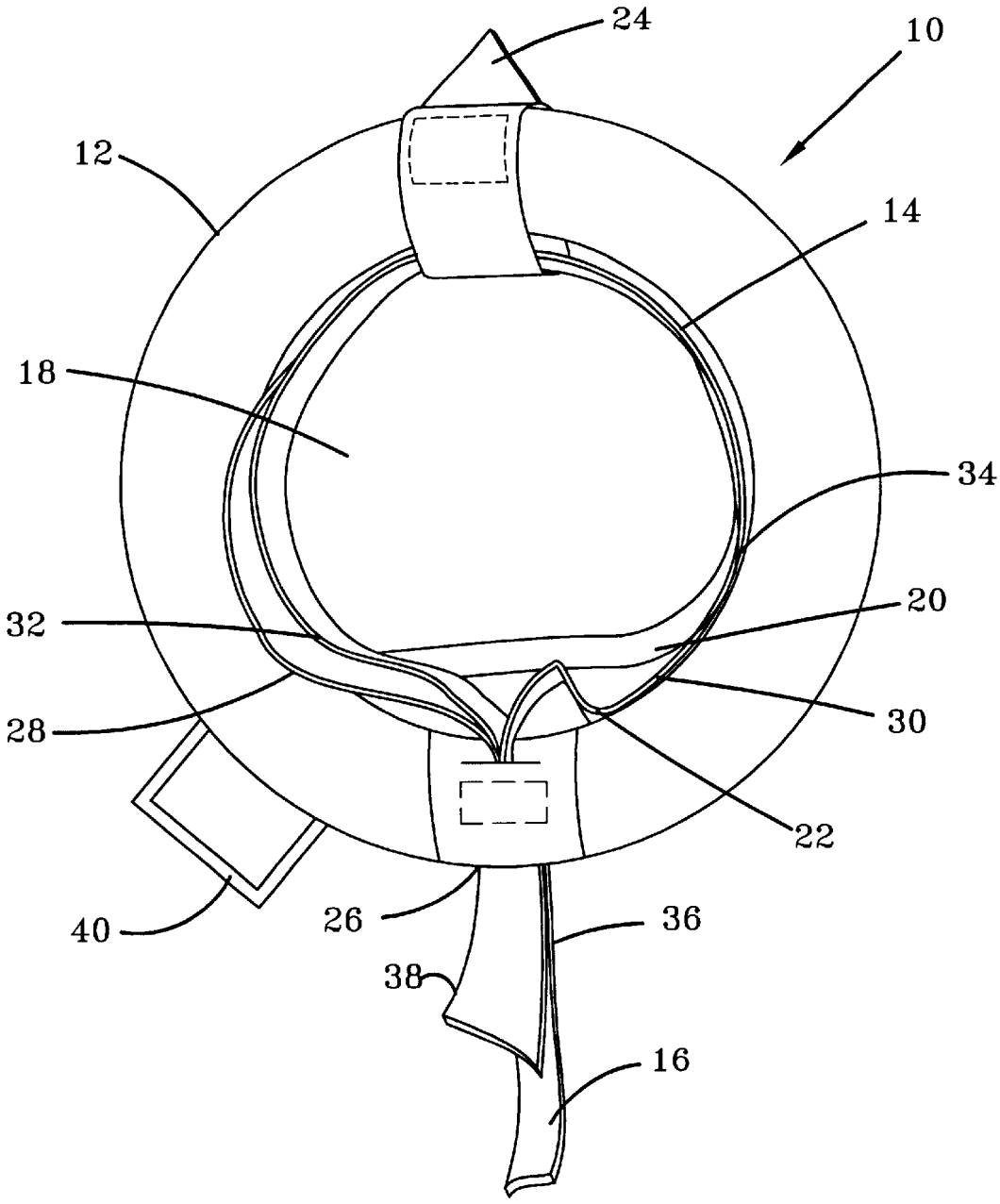
FIG. 1 is a view of a water rescue device having a belt in an unadjusted position.
Figure 2:
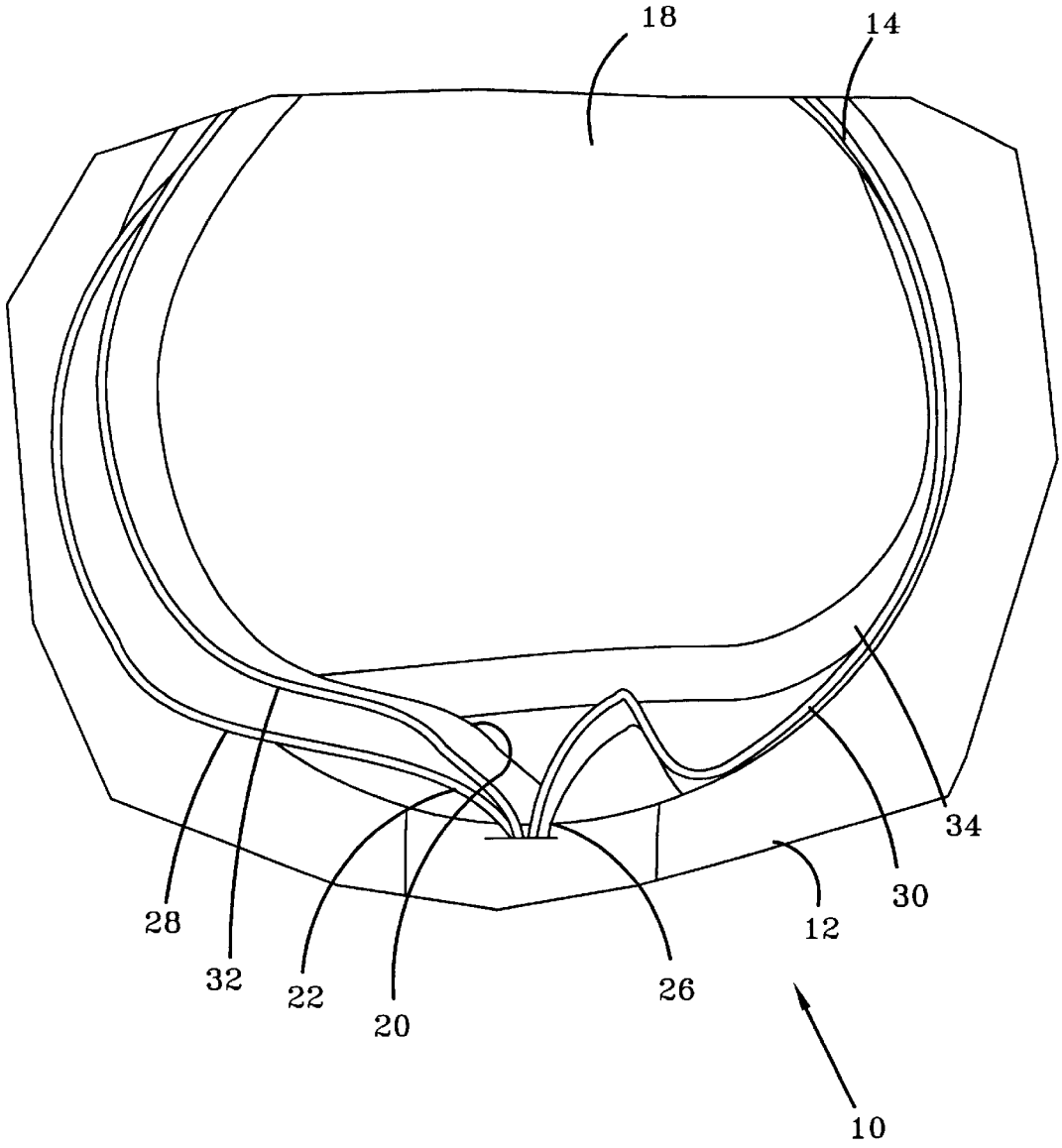
FIG. 2 is an up-close view of the attachment means.
Figure 3:
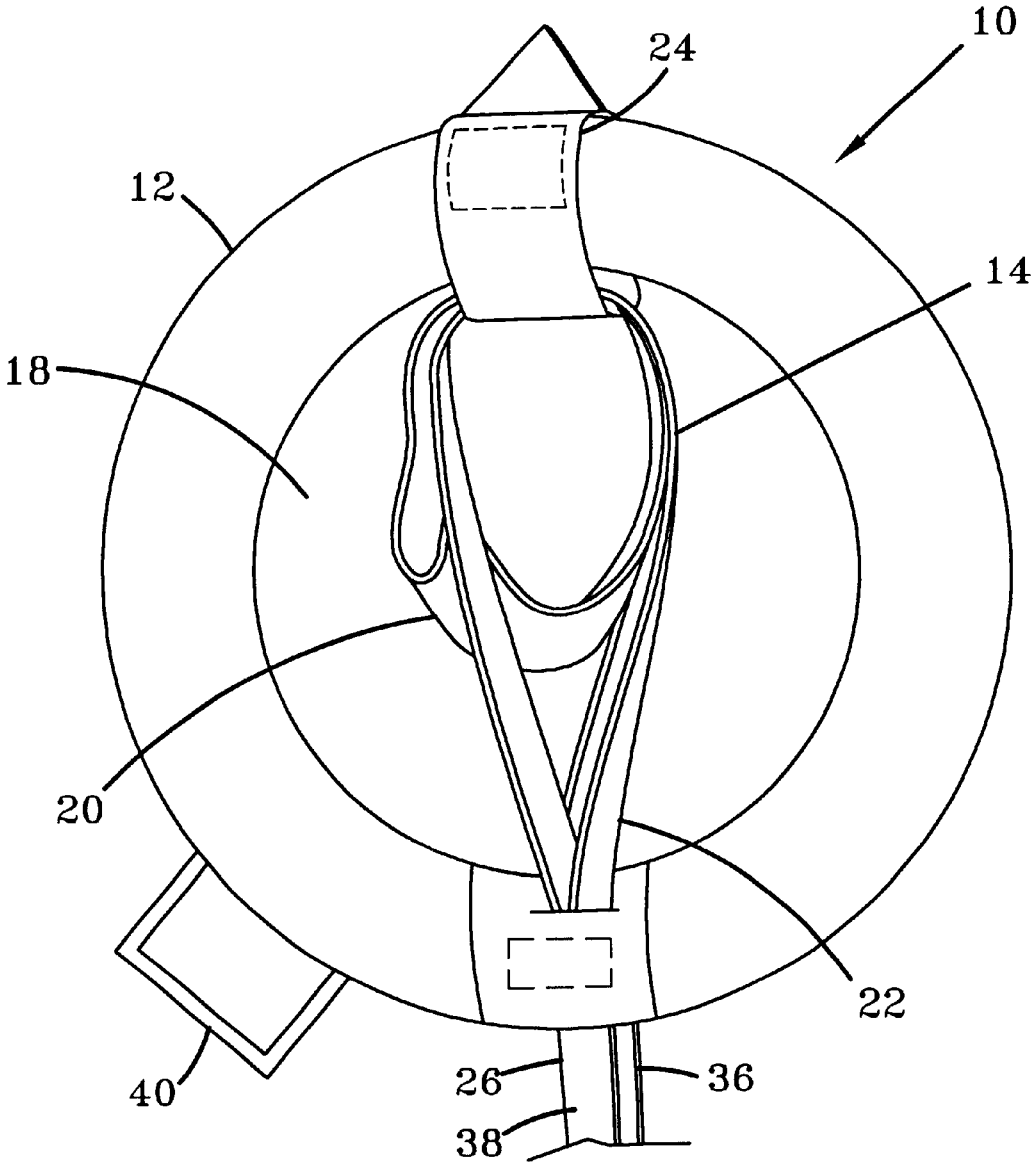
FIG. 3 is a view of the water rescue device with the belt in its adjusted position.

Referring now to the drawings, which are for purposes of illustrating a preferred embodiment of the invention only, and not for purposes of limiting the invention, FIGS. 1 and 2 show a preferred embodiment of the invention wherein an arm securing means 14 of a water rescue device 10 is in its unadjusted position and FIG. 3 shows a preferred embodiment of the invention wherein the arm securing means 14 is in an adjusted position. It should be noted that although the floatation means in this embodiment is a life ring, any type of floatation device chosen that is buoyant and will allow one to insert his or her arm within it may be used.

With reference to FIG. 1, the water rescue device 10 has a life ring 12, a arm securing means 14 that is operatively attached to the life ring 12 for securing a victim, and a rescue line 16. The life ring 12 is comprised of a generally rigid ring having a circular outer circumference and a circular central aperture 18 extending therethrough for receiving the victim's arm, shoulder, head, body, anything from the victim's body that can be inserted within the circular central aperture 18. The life ring 12 is made of a floatation material such as low density, lightweight, buoyant plastic foam. The life ring 12 may also have a vinyl covering to protect it from chipping, deterioration and other such damage as is commonly associated with life rings 12.

In the preferred embodiment, the life ring 12 has an inner diameter of approximately two feet and a width of approximately three inches, but the life ring 12 may have any dimensions so long as the life ring 12 can be adequately secured to the victim.

In the preferred embodiment, the rescue line is a rope. However, the rescue line can be any means for pulling such as a cord or a nylon line, which adequately allows the rescuer to pull the victim from the water.

With continuing reference to FIG. 1, the arm securing means 14 is located within the aperture 18 of the life ring 12 and positioned so as to form an inner loop 20 and an outer loop 22. Both the inner and the outer loops 20 and 22 are secured to the life ring 12 by a life ring securing means 24 which is operatively attached to the top side of the life ring 12. The ends of the belt 36 and 38 extend through a opening 26 in the bottom of the life ring 12, which is positioned substantially opposite of the life ring securing means 24, and are operatively attached to the rescue line 16.

In the preferred embodiment, both the diameter of the opening 26 and the width of the arm securing means 14 are approximately one inch. However, the opening 26 can have any diameter and the arm securing means 14 can have any width so long as the arm securing means 14 can be easily pulled through the opening 26.

In the preferred embodiment, the life ring securing means 24 is a strap and is used to secure the inner and outer loops 20 and 22 of the arm securing means 14 to the life ring 12, but any attachment means such as adhesives or sewing which secures the inner and outer loops 20 and 22 to the life ring 12 may be used. The victim securing means 14 is preferably a belt or other device that will be strong enough to secure the victim and flexible enough to conform to the victim.

In the preferred embodiment the length of the arm securing means 14 is approximately six to seven feet. However, the arm securing means 14 can be of any length that allows the outer loop 22 to be removeably attached to the inner loop 20 and the life ring 12 when the arm securing means 14 is in an unadjusted positioned and that allows the inner belt 20 to be securely attached to the victim's arm when the arm securing means 14 is in an adjusted position.

With reference now to FIG. 2, the outer loop 22 of the life ring 12 is removeably secured to the life ring 12 by a first attachment and second attachment means 28 and 30. The first attachment means 28 is located approximately two to five inches to the left of the opening 26 in the life ring 12. And, the second attachment means 30 is located approximately two to five inches to the right of the opening 26 in the life ring 12. Typically, the attachment means 28 and 30 will be comprised of a hook and loop means, but any means which removeably secures the outer loop 22 to the life ring 12 is within the scope of this invention.

With continuing reference to FIG. 2, the outer loop 22 is also removeably secured to the inner loop 20 of the life ring by a third and fourth attachment means 32 and 34. The third attachment means 32 is located approximately two to five inches to the left of the opening 26 in the life ring 12. While, the fourth attachment means 34 is located approximately two to five inches to the right of the opening 26 in the life ring 12. Once again, the attachment means will typically be comprised of a hook and loop means, but any means which removeably secures the outer loop 22 to the inner loop 20 is within the scope of this invention.

In the preferred embodiment, the first and second attachment means 28 and 30 will be positioned substantially opposite the third and fourth attachment means 32 and 34, respectively. However, the first, second, third and fourth attachment 28, 30, 32 and 34 means may positioned in any arrangement that adequately secures outer loop 22 to the life ring 12 and the inner loop and that allows a victim to easily place his or her arm through the inner loop 20.

In the preferred embodiment, four attachment means 28, 30, 32 and 34 are used to secure the outer loop 22 to the inner loop 20 and the life ring 12. However, a greater or a fewer number of attachment means can be used so long as the outer loop 22 is removeably secured to both the inner loop 20 and the life ring 12.

In operation, this embodiment allows the water rescue device 10 to be easily secured to a victim's arm.

With reference now to FIG. 3, the water rescue device 10 is shown in its adjusted position. After a victim places his or her arm through the inner loop 20, either the victim or the rescuer can pull on the rescue line 16 to reduce the circumference of the inner loop 20 and, thereby, secure the inner loop 20 to the victim's arm. When the rescue line 16 is pulled, the first, second, third and fourth attachment means 28, 30, 32 and 34 are released. This enables the ends of the belt 36 and 38 to move through the opening 26 in the life ring 12 toward the rescuer. As the arm securing means 14 moves through the opening 26, the inner circumference of the inner loop 20 is reduced until the circumference is substantially equal to the circumference of the victim. Once the circumference of the inner loop 20 is substantially equal to the circumference of the victim, the inner loop 20 is securely attached to the victim and the rescuer can pull the rescue line 16 to remove the victim from the water.

In the preferred embodiment, the rescue line 16 is attached to the ends of the belt 36 and 38 so that either the rescuer or the victim can secure the arm securing means 14 to the victim by pulling on the rescue line 16. However, the rescue line 16 could be operatively attached to the life ring 12 instead of the ends of the belt 36 and 38. In this configuration, only the victim would be able reach the ends of the belt 36 and 38 and, therefore, only the victim would be able to adjust the circumference of the inner loop 20. However, an attachment means such as a hook and loop means, a snap means or a buckle means could be operatively attached to the ends of the belt 36 and 38 to assist the victim in securing the belt. The attachment means would allow the victim to maintain the necessary tension on the arm securing means 14 and, thereby, keep the belt secured with a minimal amount of effort.

In the preferred embodiment, a handle (40) is attached to the flotation member (10) to give the rescuer a more secure grip on the flotation member (10) and to allow the rescuer to more easily throw the device to the victim. However, the flotation member (10) does not necessarily need a handle (40). A rescuer can obtain an adequate grip by holding onto only the flotation member (10).

With continuing reference to FIG. 3, the belt's adjustment means is comprised of the first, second, third and fourth attachment means 28, 30, 32 and 34. However, any adjustment means which enables the victim or the rescuer to vary the circumference of the inner loop 20 is within the scope of this invention.

It is understood that equivalence to the above features of this invention are within the scope of this invention.

I claim:

1. A water rescue device which can be used by a rescuer to pull a victim in distress from the water, comprising:

a floatation member having a top and a bottom side, the floatation member being made of a buoyant material and the floatation member having a circular outer circumference and a circular central aperture extending therethrough;

a belt having a first and a second end extending through an opening in the bottom side of the floatation member, the belt forming an inner and an outer loop, the inner loop being positioned substantially within the outer loop and the outer loop being positioned substantially within the aperture of the floatation member;

a strap operatively attached to the top side of the floatation member, the strap being positioned substantially opposite the opening in the floatation member, and the strap operatively securing the inner and the outer loop to the floatation member;

a first attachment means removeably securing the outer loop to a left side of the floatation member, the left side of the floatation member extending from the strap to the opening along the left side of the floatation member;

a second attachment means removeably securing the outer loop to a right side of the floatation member, the right side of the floatation member extending from the strap to the opening along the right side of the floatation member;

a third attachment means located in substantially the same position as the first attachment means, the third attachment means removeably securing the inner loop to the outer loop;

a fourth attachment means located in substantially the same position as the first attachment means, the fourth attachment means removeably securing the inner loop to the outer loop; and, a rescue line attached to the first and the second ends of the belt, whereby a rescuer or a victim can pull the rescue line to remove the first, second, third, and fourth attachment means from their respective secured positions.

2. The water rescue device of claim 1 wherein the floatation member is a life ring.

3. The water rescue device of claim 2 wherein the life ring is made of a low density, light weight, buoyant plastic foam material.

4. The water rescue device of claim 3 wherein the life ring has a vinyl covering.

5. The water rescue device of claim 2 wherein the life ring has an inner diameter of about two feet and a width of about three inches, whereby the inner diameter of the line ring is wide enough to receive the shoulder, head, body, or arm of a victim.

6. The water rescue device of claim 5 wherein the belt has a length of about six to seven feet, whereby the belt is long enough to form two loops having diameters substantially equal to the inner diameter of the life ring.

7. The water rescue device of claim 1 wherein the opening of the floatation member has a diameter of about one inch and the belt has a width of about one inch, whereby the diameter of the opening is wide enough to receive the belt.

8. The water rescue device of claim 1 wherein the strap has a width of about one inch.

9. The water rescue device of claim 1 wherein the first, the second, the third and the fourth attachment means are a hook and loop means.

10. The water rescue device of claim 1 wherein the rescue line is a rope.

11. The water rescue device of claim 1 wherein a handle is operatively attached to the flotation member.

* * * * *